US007357141B2

(12) United States Patent
Janietz et al.

(10) Patent No.: US 7,357,141 B2
(45) Date of Patent: Apr. 15, 2008

(54) VALVE ASSEMBLY WITH AN ADJUSTABLE FUNCTION, AND A METHOD THEREFOR

(75) Inventors: Ulrich Janietz, Hannover (DE); Wolfgang Brandes, Hannover (DE); Ernst-August Meyer, Wennigsen (DE); Thomas Liesenhoff, Hannover (DE)

(73) Assignee: Rexroth Mecman GmbH, Hannover (DE)

( * ) Notice: Subject to any disclaimer, the term of this patent is extended or adjusted under 35 U.S.C. 154(b) by 544 days.

(21) Appl. No.: 10/962,961

(22) Filed: Oct. 12, 2004

(65) Prior Publication Data

US 2005/0081915 A1 Apr. 21, 2005

(30) Foreign Application Priority Data

Oct. 15, 2003 (DE) ..... 103 47 936

(51) Int. Cl.
*F17D 1/00* (2006.01)

(52) U.S. Cl. ..... 137/1; 137/269; 137/271

(58) Field of Classification Search ..... 137/269, 137/270, 271, 884, 1
See application file for complete search history.

(56) References Cited

U.S. PATENT DOCUMENTS 3,707,163 A 12/1972 Hugler
5,048,569 A 9/1991 Stoll et al.
5,222,524 A * 6/1993 Sekler et al. ..... 137/884
6,832,622 B2 * 12/2004 Hassel et al. ..... 137/269

FOREIGN PATENT DOCUMENTS

| | | |
|---|---|---|
| DE | 36 469 | 4/1965 |
| DE | 42 26 539 | 2/1994 |
| DE | 44 09 667 | 8/1995 |
| DE | 94 21 326 | 10/1995 |
| DE | 102 04 250 | 8/2003 |
| GB | 2 301 167 | 11/1996 |

* cited by examiner

*Primary Examiner*—Kevin Lee
(74) *Attorney, Agent, or Firm*—Henry M. Feiereisen; Ursula B. Day

(57) ABSTRACT

A valve assembly includes at least one multiport valve for controlling and applying pressure to a pneumatic unit and a base plate having passageways for supplying compressed fluid to a multiport valve and for draining compressed fluid from the multiport valve. Interposed between the base plate and the multiport valve is a grid plate for functional differentiation of the valve assembly and determination of the valve assembly function.

8 Claims, 2 Drawing Sheets

VALVE ASSEMBLY WITH AN ADJUSTABLE FUNCTION, AND A METHOD THEREFOR

CROSS-REFERENCES TO RELATED APPLICATIONS

This application claims the priority of German Patent Application, Serial No. 103 47 936.8-14, filed Oct. 15, 2003, pursuant to 35 U.S.C. 119(a)-(d), the disclosure of which is incorporated herein by reference.

BACKGROUND OF THE INVENTION

The present invention relates, in general, to the field of multiport valves, and more particularly to a valve assembly and a method for functional differentiation of a valve assembly.

Nothing in the following discussion of the state of the art is to be construed as an admission of prior art.

Valves have various functional characteristics depending on the specific requirements, e.g. 2/2, 3/2 NO, 3/2 NC, 4/2 monostable, 4/2 bistable, 4/3 vented, 4/3 blocked, 4/3 vacuum-vented, 5/2 monostable, 5/2 bistable, 5/3 vented, 5/3 blocked, 5/3 vacuum-vented etc. With sliding valves, the various valve functions can be realized, for example, with different valve slides.

In conventional multiport valves, the adjustment of these functional characteristics requires a multitude of different components, depending on which valve function is desired. On the other hand, the structural requirements of valves are often the same with respect to their geometric dimensions since they are positioned side by side on a base plate.

German utility model no. DE 94 21 326 discloses a multiport valve in which a 5/2 multiport valve can be transformed into two 3/2 multiport valves using the two-way design of a valve rod. This transformation is, however, complicated and not all the usual valve types can be adjusted.

It would therefore be desirable and advantageous to provide an improved valve assembly and an improved method for functional differentiation of a valve assembly to obviate prior art shortcomings and to allow adjustment of the functional differentiation or the determination of the valve function in a simple manner.

SUMMARY OF THE INVENTION

According to one aspect of the present invention, a valve assembly includes at least one multiport valve for controlling operation of a fluid-operated pneumatic unit, a base plate having passageways for supply of compressed fluid to the multiport valve and drainage of compressed fluid from the multiport valve, and a grid plate disposed between the base plate and the multiport valve for functional differentiation of the valve assembly and determination of the valve assembly function.

The present invention resolves prior art problems by interposing a grate plate between the base plate and the multiport valve for determination of the particular function of the valve assembly. As a result, the base plate and the multiport valve can have a uniform structure for all valve types. The function of the valve assembly is determined by the grid plate. It is to be understood by persons skilled in the art that the term "grid plate" is used here in a generic sense and the principles described in the following description with respect to the grid plate are equally applicable to any device which generally follows the concepts outlined here and is capable of being used for functional differentiation of a valve or for determining a valve function for the application at hand.

According to another feature of the present invention, the grid plate may have pneumatic lines for connecting the passageways of the base plate and the multiport valve for functional differentiation of the valve assembly and determination of the valve assembly function. In this way a function differentiation can be achieved in a simple manner.

According to another feature of the present invention, the grid plate may have electrical lines and/or electrical devices for connection to and/or the control of the base plate, the multiport valve or a pilot valve for functional differentiation of the valve assembly and determination of the valve assembly function. In this way the functional differentiation can also easily be achieved, and further ways to control the valve are provided.

The valve assembly is adjustable by means of the grid plate, preferably to any one of the functions of the group comprising: 2/2, 3/2 NO, 3/2 NC, 3/2 monostable, 4/2 bistable, 4/3 vented, 4/3 blocked, 4/3 vacuum-vented, 5/2 monostable, 5/2 bistable, 5/3 vented, 5/3 blocked, 5/3 vacuum-vented. This means that almost all the usual valve types can easily be adjusted.

According to another feature of the present invention, the grid plate is part of a modular kit including a plurality of grid plates to allow exchange of grid plates. The term "exchange" or "exchangeable" in the context of the present invention, relates hereby in particular to the capability to modify the functional differentiation of the valve, without dismantling the valve or the multiport valve. It is thus possible to change the functional characteristics of the valve in a simple manner and to minimize downtimes and/or production losses, even when the valves have already be assembled and have been in use.

According to another feature of the present invention, the base plate and/or the multiport valve are constructed for form-fitting or aligned attachment of the grid plate.

According to another aspect of the present invention, in a method for functional adjustment of a valve assembly having a multiport valve for controlling operation of a fluid-operated pneumatic unit, and a base plate provided with passageways for supplying compressed fluid to the multiport valve and for drainage of compressed fluid from the multiport valve, a grid plate is selected from a modular kit comprised of a plurality of grid plates, and the selected grid plate is placed between the base plate and the multiport valve for realizing a particular function of the valve assembly.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
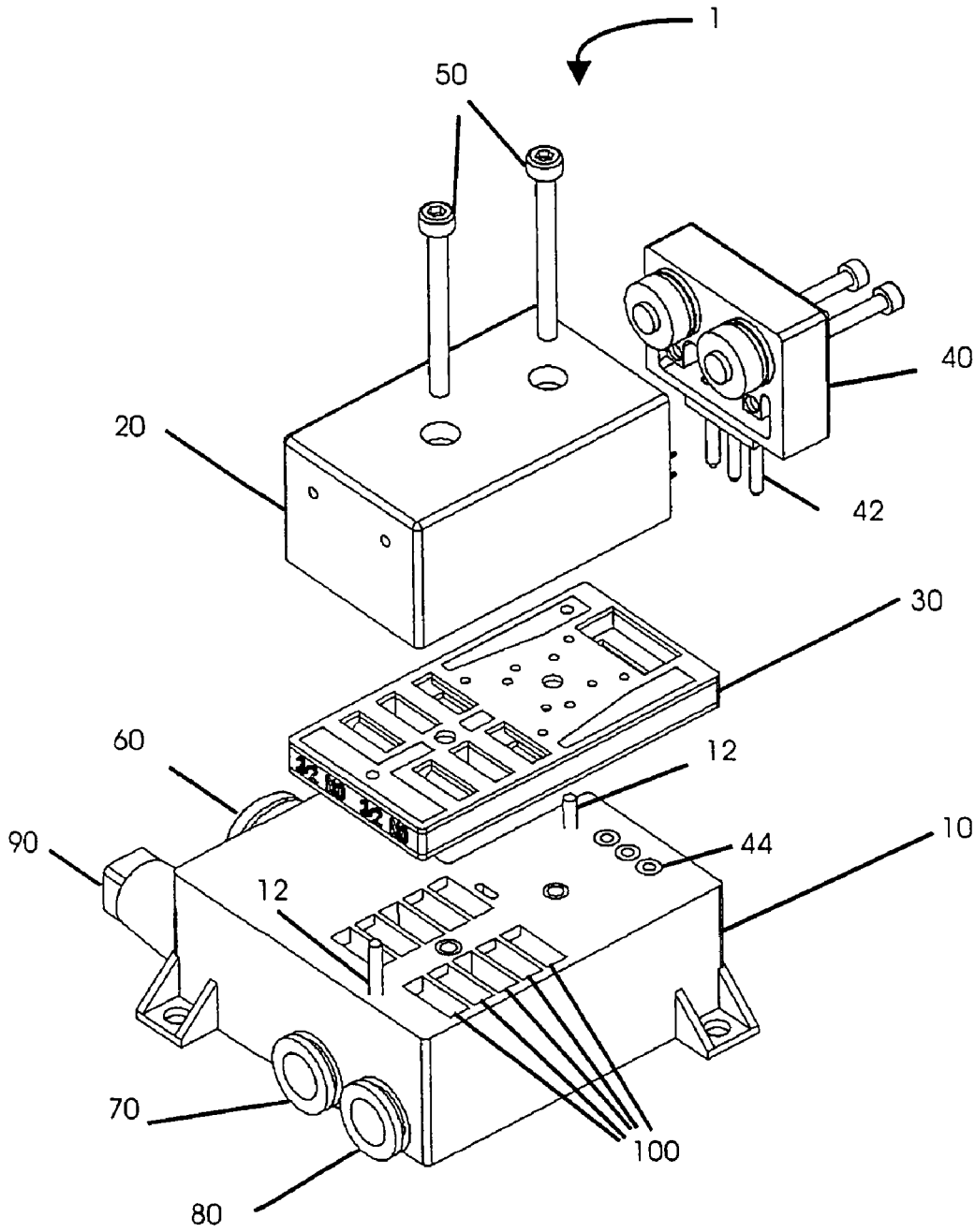
FIG. 1 is an exploded view of one embodiment of a valve assembly according to the present invention having two valve slides.
Figures 2A, 2B, 2C, 2D:
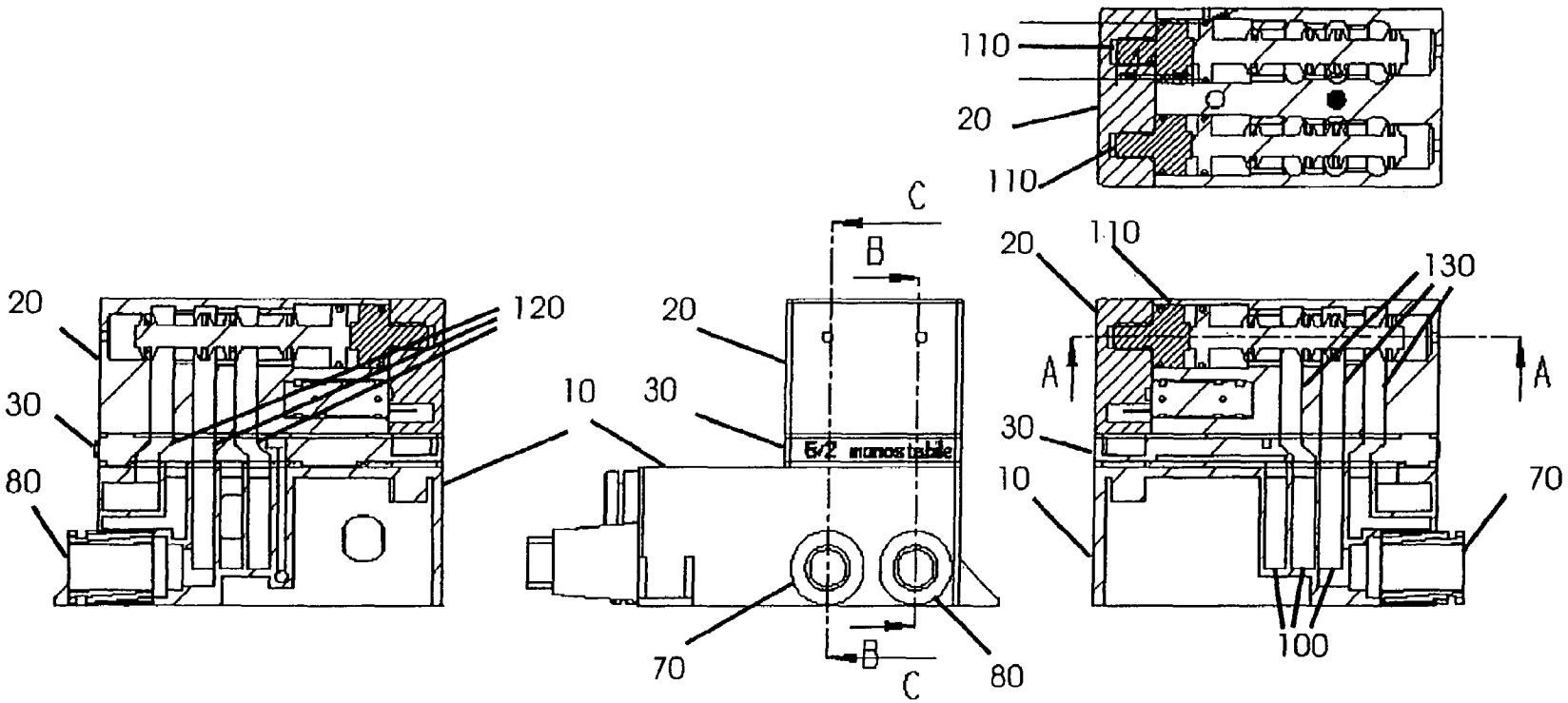
FIG. 2*a* is an elevational view of another embodiment of a valve assembly according to the present invention with a different grid plate.
FIG. 2*b* is a horizontal sectional view of the valve assembly of FIG. 2*a*, taken along the line A-A in FIG. 2*d*, modified with a different grid plate.
FIG. 2*c* is a vertical sectional view of the valve assembly of FIG. 2*a*, taken along the line C-C in FIG. 2*a*.
FIG. 2*d* is a vertical sectional view of the valve assembly of FIG. 2*a*, taken along the line B-B in FIG. 2*a*.

Throughout all the Figures, same or corresponding elements are generally indicated by same reference numerals. These depicted embodiments are to be understood as illustrative of the invention and not as limiting in any way. It should also be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 1, there is shown an exploded view of a valve assembly according to the present invention, generally designated by reference numeral 1 and including two valve slides according to a first embodiment of the present invention. The valve assembly 1 includes a base plate 10, a multiport valve 20, and a pilot valve 40. The base plate 10 has two working pressure lines 70, 80 for applying compressed air to a pneumatic unit (not shown), such as a pneumatic cylinder, a feeder pressure line 60, a vent line 90 and a plurality of pneumatic lines 100 arranged on top of base plate 10.

Disposed between the base plate 10 and the multiport valve 20 is a grid plate 30 for functional differentiation of both valve slides. The base plate 10 is provided with anchors 12 in the form of studs 12 for form-fitting or aligned attachment of the grid plate 30 to the base plate 10 and the at least one multiport valve 20. As an alternative, or in addition, the studs 12 can also be formed on the multiport valve 20. It is thus ensured that the grid plate 30 can be arranged between the base plate 10 and the multiport valve 20 in a secure and precise way.

FIGS. 2*a-d* show a valve assembly adjusted as a 5/2 monostable multiport valve. Parts corresponding with those in FIG. 1 are denoted by identical reference numerals and not explained again. The description below will center on the differences between the embodiments. In the presently preferred embodiment, the grid plate 30 is structured such that it includes at least one pneumatic line 120. As can be seen from FIGS. 2*c* and 2*d*, the grid plate 30 has for each valve slide 110 three pneumatic lines 120 which selectively connect some or all of the pneumatic lines 100 arranged on the base plate 10 with selected lines 130 of the multiport valve and ultimately with the valve slides 110. Depending on the connection of the lines 100 with the lines 130, a different functional characteristic of the valve is achieved. Thus, valves of most varied functions can be adjusted, including, but not limited to: 2/2, 3/2 NO, 3/2 NC, 4/2 monostable, 4/2 bistable, 4/3 vented, 4/3 blocked, 4/3 vacuum-vented, 5/2 monostable, 5/2 bistable, 5/3 vented, 5/3 blocked, 5/3 vacuum-vented.

The base plate 10 and the multiport valve 20 are applicable for any of the various valves, without modification. As a result, manufacture and maintenance of the valves are greatly simplified, and the number of components required for making different valves is also reduced since the function is determined by the grid plate 30, while the other components remain the same.

The grid plate 30 can be made of any material known to the artisan in the field of valves. Currently preferred is the manufacture of the grid plate 30 from a two component part comprised of a hard plastic as a carrier, and a resilient material as a sealing material (e.g. POM/AU).

The pilot valve 40 shown in FIG. 1 is provided with lines or plugs 42 fitting into corresponding connections 44 of the base plate 10. In another embodiment of the present invention, the grid plate 30 may additionally be provided with electrical lines and/or electrical devices (not shown in the drawing) which are interposed between the pilot valve 40 and the connections 44 for control of the pilot valve 40. This may be advantageous in particular when it is necessary for the two valve slides of multiport valve 20 to be actuated in synchronism. This may be ensured by a corresponding circuit on the grid plate 30. In the event, synchronous actuation of the valve slides is not required, a different connecting scheme can be used when a different grid plate is used—or the electrical lines may be simply omitted. Of course, it is also conceivable to also control the base plate 10 and/or the multiport valve 20 by electrical lines and/or devices in the grid plate 30.

In one advantageous embodiment of the invention, the grid plate is exchangeable. This can be realized, for example, by simply allowing the grid plate 30 to be slid out to the side. By inserting a different grid plate, a valve having a different function can easily be adjusted.

In the present embodiment, the valve assembly has two valve slides. Of course, grid plates that allow only one valve slide or more than two valve slides to be functionally adjustable are also conceivable.

While the invention has been illustrated and described in connection with currently preferred embodiments shown and described in detail, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein.

What is claimed is:

1. A valve assembly, comprising:

at least one multiport valve for controlling operation of a fluid-operated pneumatic unit:

a base plate having passageways for supply of compressed fluid to the multiport valve and drainage of compressed fluid from the multiport valve; and a grid plate disposed between the base plate and the multiport valve for functional differentiation of the valve assembly and determination of the valve assembly function, wherein the grid plate is part of a modular kit including a plurality of grid plates to allow exchange of grid plates.

2. The valve assembly of claim 1, wherein the grid plate has pneumatic lines for connecting the passageways of the base plate and the multiport valve for functional differentiation of the valve assembly and determination of the valve assembly function.

3. The valve assembly of claim 1, wherein the grid plate has electrical lines and/or electrical devices for connection to and/or the control of the base plate, the multiport valve or a pilot valve for functional differentiation of the valve assembly and determination of the valve assembly function.

4. The valve assembly of claim 1, wherein the valve assembly is adjustable by the grid plate to a function selected from the group consisting of 2/2, 3/2 NO 3/2 NC, 4/2 monostable, 4/2 bistable, 4/3 vented, 4/3 blocked, 4/3 vacuum-vented, 5/2 monostable, 5/2 bistable, 5/3 vented, 5/3 blocked, and 5/3 vacuum-vented.

5. The valve assembly of claim 1, wherein the base plate and/or the multiport valve have means for form-fitting or aligned attachment of the grid plate.

6. A method for functional adjustment of a valve assembly having a multiport valve for controlling operation of a fluid-operated pneumatic unit, and a base plate provided with passageways for supplying compressed fluid to the multiport valve and for drainage of compressed fluid from the multiport valve, said method comprising the steps of:

selecting a grid plate from a modular kit comprised of a plurality of grid plates; and placing the selected grid plate between the base plate and the multiport valve for realizing a particular function of the valve assembly.

7. The method of claim 6, the particular function is selected from the group consisting of 2/2, 3/2 NO, 3/2 NC, 4/2 monostable, 4/2 bistable, 4/3 vented, 4/3 blocked, 4/3 vacuum-vented, 5/2 monostable, 5/2 bistable, 5/3 vented, 5/3 blocked, and 5/3 vacuum-vented.

8. The method of claim 6, wherein the selected grid plate is replaceable by another one of the grid plates for realizing a different function of the valve assembly.

* * * * *